US010854999B1

(12) United States Patent
Price et al.

(10) Patent No.: US 10,854,999 B1
(45) Date of Patent: Dec. 1, 2020

(54) ANGLED ELECTRICAL HEADER CONNECTORS

(71) Applicant: TE Connectivity Corporation, Berwyn, PA (US)

(72) Inventors: Matthew G. Price, Winston-Salem, NC (US); Michael S. Glick, Winston-Salem, NC (US); Charles L. Phelps, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/453,968

(22) Filed: Jun. 26, 2019

(51) Int. Cl.

| | |
|---|---|
| ***H01R 4/26*** | (2006.01) |
| ***H01R 13/04*** | (2006.01) |
| ***H01R 13/50*** | (2006.01) |
| ***H01R 13/659*** | (2011.01) |

(52) U.S. Cl.
CPC ..... *H01R 4/26* (2013.01); *H01R 13/04* (2013.01); *H01R 13/50* (2013.01); *H01R 13/659* (2013.01)

(58) Field of Classification Search
CPC ..... H01R 4/26; H01R 13/04; H01R 13/50; H01R 4/56; H01R 13/6585; H01R 13/659; H01R 13/658
See application file for complete search history.

(56) References Cited

U.S. PATENT DOCUMENTS

| | | | | |
|---|---|---|---|---|
| 6,679,728 | B1 * | 1/2004 | Huang | H01R 24/545 200/51.09 |
| 9,048,587 | B2 * | 6/2015 | Marsh | H01R 11/12 |
| 2004/0137790 | A1 * | 7/2004 | Lee | H01R 4/28 439/582 |

* cited by examiner

*Primary Examiner* — Nguyen Tran
*Assistant Examiner* — Paul D Baillargeon

(57) ABSTRACT

Angled electrical header connectors comprise a housing with a first electrical terminal port and a second electrical terminal port oriented apart from one another. A first electrical terminal is disposed within the first electrical terminal port, and a first electrical insulator is interposed between the first electrical terminal port and the first electrical terminal. A second electrical terminal is disposed within the second electrical terminal port, and a second electrical insulator is interposed between the second electrical terminal port and the second electrical terminal. A passage exists between the first electrical terminal port and the second electrical terminal port, and one of the first electrical terminal or the second electrical terminal extends into the electrical terminal port of the other of the first electrical terminal or the second electrical terminal to make an electrical-mechanical connection therebetween in situ within the housing.

20 Claims, 5 Drawing Sheets

ANGLED ELECTRICAL HEADER CONNECTORS

FIELD

Angled electrical header connectors are typically used in high-power transmission applications to provide an electrical connection between terminals in an angled orientation relative to one another. More particularly, this disclosure relates to right-angle electrical headers that are specially configured to have a reduced size and to provide a highly reliable and robust connection in such high-power transmission applications in a manner that is resistant to vibration.

BACKGROUND

The use of angled electrical header connectors, specifically right-angle electrical headers that are configured to provide an electrical connection between terminals oriented at a right-angle or 90 degrees relative to one another, is known in the art. In such conventional right-angle electrical headers, the two electrical terminals of the header are attached at right-angles to one another outside of the connector housing, and the combined terminals are then introduced into the housing to thereby form the right-angle header. Due to combining the electrical terminals together outside of the housing, the housing in such conventional right-angle headers is sized to accommodate insertion and positioning of the right-angle attached terminals within the housing. As a result, the housing ends up being relatively large to accommodate the 90 degree attached terminals. Additionally, such conventional right-angle electrical headers that utilize externally pre-assembled terminals often require the use of a multi-piece housing to fit size constraints. The use of such a multi-piece housing requires that the different pieces of the housing be properly assembled and then sealed, which increases cost and reduces reliability.

Right-angle headers are typically reserved for those end-use applications that are space constrained (e.g., where using electrical connectors with conventional axially opposed electrical terminals is not possible). Thus, the resulting relatively large size of such conventional right-angle headers may not provide a desired degree of space savings useful to meet the needs of certain space constrained end-use connector applications. While it may be possible to reduce the size of such conventional right-angle electrical headers by certain conventional approaches, the cost associated with such size reduction would be high, thereby making the part expensive and commercially undesirable.

Further, the construction of such conventional right-angle headers (making use of the externally pre-attached electrical terminals and insulating materials that are inserted into the housing during or after installation of the attached terminals) may not provide the highest degree of assurance that all sections of the electrical terminals are adequately electrically insulated from adjacent portions of the connector housing (e.g., to eliminate the possibility of a short circuit when used in high-power transmission applications subject to high levels of vibration) which is especially important both for safety reasons and for purposes of ensuring a desired effective service life of the connector.

It is therefore desired that angled electrical header connectors be constructed in a manner that provides a reduced packaging size when compared to conventional right-angle electrical header connectors to thereby increase the flexibility and spectrum of possible end-use applications. It is also desired that such angled electrical connectors be constructed having a housing that avoids the cost and reliability issues associated with assembly and sealing of conventional multi-piece housings. It is further desired that such angled electrical connectors be constructed in a manner ensuring an improved degree of insulation protection between the terminals and the connector housing, and providing a robust connection between the terminals, thereby ensuring an improved degree of vibration resistance and ensuring effective service life when used in high-power transmission end-use applications as compared to conventional right-angle electrical header connectors.

SUMMARY

Angled electrical header connectors comprise a housing that includes a first electrical terminal port and a second electrical terminal port. In an example, the housing is a one-piece construction. In an example, the first electrical terminal port is oriented approximately 90 degrees from the second electrical terminal port. In an example, the first electrical terminal port and the second electrical terminal port are integral with the housing. A first electrical terminal is disposed within the first electrical terminal port, and a first electrical insulator is interposed between the first electrical terminal port and the first electrical terminal. A second electrical terminal is disposed within the second electrical terminal port, and a second electrical insulator is interposed between the second electrical terminal port and the second electrical terminal. In an example, the first electrical terminal is a round pin terminal and the second electrical terminal is a flat terminal. In an example, the housing first electrical terminal port and the housing second electrical terminal port are separated by a housing wall having a passage therein extending between the first and second electrical terminal ports. In an example, the first electrical terminal and the second electrical terminal each include axial ends extending outwardly from the respective first electrical terminal port and second electrical terminal port. The first electrical terminal and the second electrical terminal each include an attachment feature configured to complement one another for attaching and making an electrical-mechanical connection with one another while disposed within the housing. In an example, one attachment feature may be an axial end of one of the first electrical terminal or the second electrical terminal, and the other attachment feature may be an opening in the other of the first electrical terminal or second electrical terminal that is configured to accept placement of the axial end therein. In an example, the first electrical terminal includes the axial end that extends through the passage between the first electrical terminal port and the second electrical terminal port to the second electrical terminal and makes the electrical-mechanical connection second electrical terminal. In an example, the electrical-mechanical connection between the first electrical terminal and the second electrical terminal is made in situ within the housing by axial movement of one electrical terminal within its respective electrical terminal port into contact with the other electrical terminal disposed within its respective electrical terminal port.

A method for making angled electrical header connections comprises forming a first electrical terminal and insulator assembly and a second electrical terminal and insulator assembly, and inserting the first electrical terminal and insulator assembly and the second electrical terminal and insulator assembly into the respective first electrical terminal port and the second electrical terminal port. One of the first electrical terminal or second electrical terminal is displaced within its respective electrical terminal port to form the electrical-mechanical connection with the other of the first electrical terminal or the second electrical terminal in situ within the housing.

BRIEF DESCRIPTION OF THE DRAWINGS

Angled electrical header connectors will now be described by way of example with reference to the accompanying figures, wherein like reference numerals refer to like elements, and of which.

DETAILED DESCRIPTION

Figure 1:
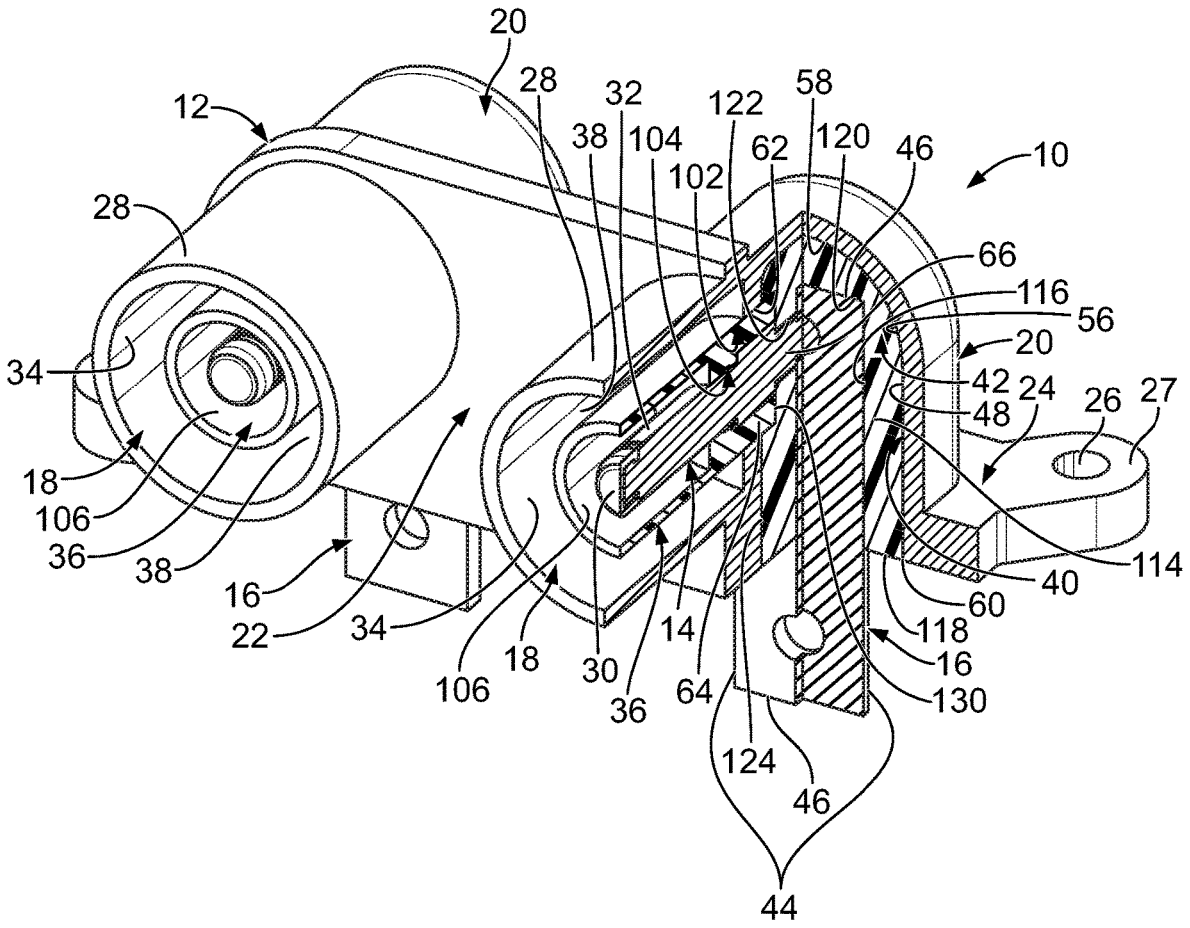
FIG. 1 is a perspective frontside view of an example angled electrical header connector with a cross-section portion illustrating internal components, in accordance with various embodiments.

Embodiments of angled electrical header connectors will be described herein in detail with reference to the attached drawings, wherein like reference numerals refer to the like elements. Angled electrical header connectors may, however, be embodied in many different forms and should not be construed as being limited to the embodiments set forth herein; rather, these embodiments are provided so that the disclosure will be thorough and complete, and will fully convey the concept of angled electrical header connectors to those skilled in the art.

Angled electrical header connectors are generally configured for use as a right-angle electrical header for providing an electrical connection in high-power transmission applications. In an example, such right-angle electrical header connectors comprise a first electrical terminal 14 and a second electrical terminal 16 that are respectively in the form of a round pin terminal and a flat terminal. The first electrical terminal 14 and the second electrical terminal 16 are oriented at an about right-angle or about 90 degrees relative to one another inside of a housing of the connector. The right-angle header and the terminals are specially engineered to accommodate electrical and mechanical attachment of the terminals to one another in-situ while disposed in the housing, thereby reducing the overall packaging size of the right-angle header connector. Further, the first electrical terminal 14 and the second electrical terminal 16 are configured to include insulating members that have been specially developed to ensure that the terminals are thoroughly insulated from the housing, and to ensure that the terminals are aligned within the housing to facilitate an accurate connection point with an external connector. Configured in this manner, right-angle header connectors provide a reduced package size, while displaying an improved degree of resistance to high vibration in high-power transmission service when compared to conventional right-angle headers.

FIG. 1 illustrates an example angled electrical header 10 comprising a housing 12 configured to accommodate the attachment and placement of first electrical terminal 14 and second electrical terminal 16 therein. In this example, the housing is shown comprising a pair of first terminal ports 18 that extend outwardly from the housing and that each accommodates a first electrical terminal 14 therein. The housing comprises a pair of second terminal ports 20 that extend at about a right-angle or about 90 degrees from the respective first terminal ports 18 and each accommodates a second electrical terminal 16 disposed therein. While a housing 12 has been illustrated comprising a pair of first terminal ports 18 and second terminal ports 20, it is to be understood that angled header connectors may comprise a housing configured to include a single first terminal port 18 and a second terminal port 20, or more than two first terminal ports 18 and second terminal ports 20 depending on the particular end-use application.

In an example, the housing 12 is formed from a structurally rigid material that may be either electrically conductive (e.g., metallic or the like) or that may be electrically non-conductive (e.g., a plastic or polymeric material or the like). In an example, the housing is formed from a metallic material. The housing may be formed by a molding process, a machining process or by other process depending on the particular housing configuration and/or material used to form the same. In an example, the housing is molded from aluminum. In an example, the housing is a one-piece integral construction, thereby avoiding the need to assemble and seal separate parts or pieces to form the housing, that provides an improved degree of reliability and cost savings.

Figure 2:
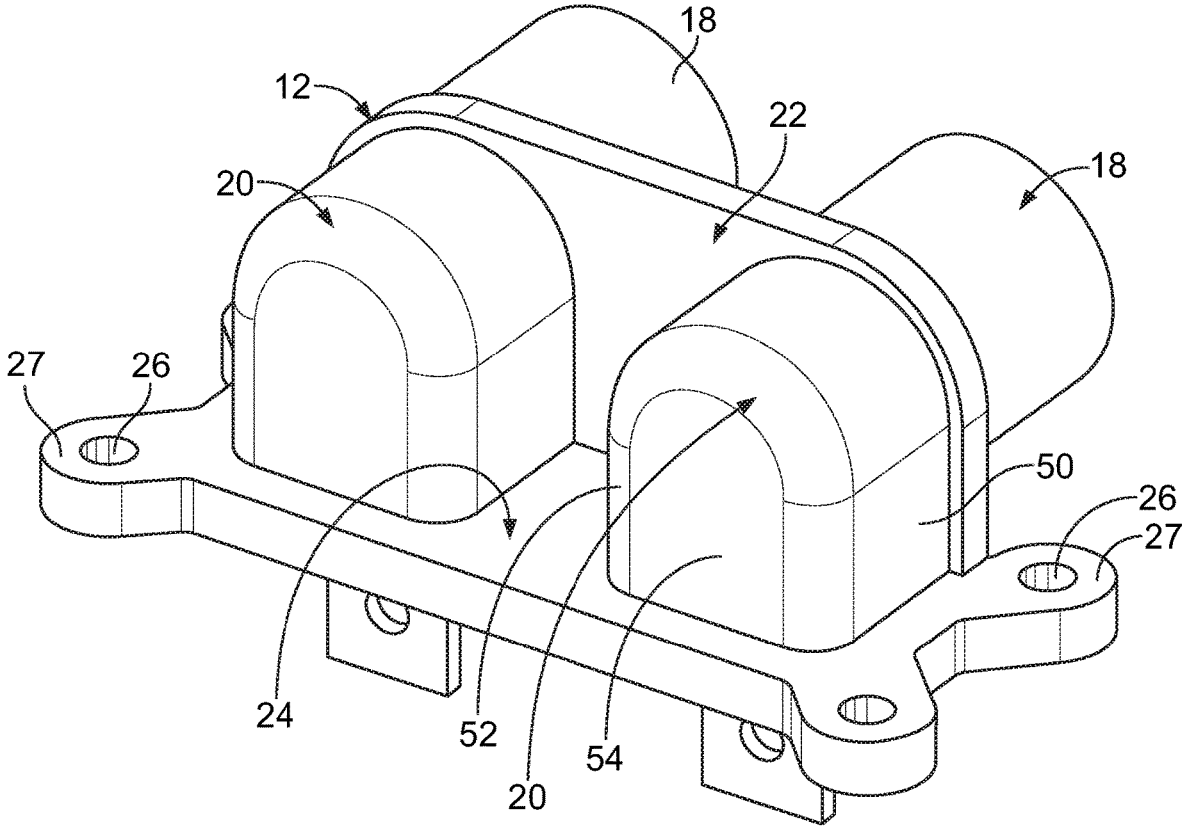
FIG. 2 is a perspective backside view of the angled electrical header connector of FIG. 1, in accordance with various embodiments.

Referring to FIGS. 1 and 2, the housing 12 includes a structural connecting member 22 that extends laterally between and that is connected with both the pair of first terminal ports 18 and the pair of second terminal ports 20. In an example, the connecting member 22 is in the form of a plate element that is integral with housing 12 and the first terminal ports 18 and second terminal ports 20. The connecting member 22 is connected with and extends vertically upwardly from a housing base 24 that is oriented perpendicular to the connecting member 22. The housing base 24 is in the form of a plate element that extends peripherally around and connects together the pair of second terminal ports 20. Like the connecting member 22, the base 24 is integral with the pair of second terminal ports 20 and is integral with the housing. In an example, the base 24 includes holes 26 that are disposed therethrough and that are positioned at attachment lugs 27 that each extend outwardly from the base. In this example, the attachment lugs are positioned at each of four corners of the housing base 24, and the holes 26 facilitate mounting the connector housing to an external object or surface.

Referring to FIG. 1, in an example, the first terminal ports 18 of the housing are each configured having a cylindrical wall 28 extending axially outwardly a distance from the connecting member 22. In an example, the cylindrical wall extends an axial distance that is greater than an axial end 30 of a connecting portion 32 of the first electrical terminal 14 so as to protect the axial end 30 of the first electrical terminal 14 from being inadvertently contacted with an external object. In an example, the cylindrical wall 28 has an inside diameter 34 sized to accommodate placement of the first electrical terminal 14 therein as combined with a first electrical terminal insulating element or insulator 36 disposed concentrically around the first electrical terminal 14. In an example, the cylindrical wall inside diameter 34 is sized to provide an open annular space 38 of sufficient radial dimension between the inside diameter 34 and the first electrical terminal insulator 36 to accommodate placement of an external connector feature (not shown) therein (e.g., when making an electrical connection with the first electrical terminal 14).

In an example, the first electrical terminal 14 is provided in the form of a round or cylindrical pin terminal having a circular cross-section. In an example, the pin terminal may have a diameter of about 8 mm along the connecting portion 32. In an example, the pin terminal is made from conductive materials such as metals and metal alloys, and in a specific example is made from a copper alloy. However, it is to be understood that angled header connectors are intended to be used with first electrical terminals 14 that may be sized and shaped differently than as specifically described and illustrated depending on the particular end-use application. In an example where the first electrical terminal 14 is other than a pin terminal, the configuration of the first terminal port 18 may vary to accommodate such first electrical terminal 14 configuration, which variation is intended to be within the scope of angled header connectors as disclosed herein. For example, rather than being configured in the form of a pin terminal, first electrical terminals 14 as used in angled header connectors may be configured in the form of receptacle terminals or the like and be configured to provide attachment with the second electrical terminals 16 in situ within the connector housing, and such alternative configuration is intended to be within the scope of angled header connectors as disclosed herein.

In an example, the housing second terminal ports 20 each have an internal cavity 40 that is configured to accommodate the second electrical terminal 16 therein along with a second insulating element or insulator 42 disposed around the second electrical terminal 16. In an example, the second electrical terminal 16 is in the form of a flat terminal having a generally rectangular shape comprising opposed long sides 44 and opposed short sides 46. The second electrical terminal 16 may be formed from the same types of electrically conductive materials used to form the first electrical terminal 14, and in an example is formed from copper. In an example, the second terminal port internal cavity 40 is configured having a first section 48 that extends a distance vertically outwardly from the housing base 24 and that has a width as defined by opposed cavity wall sections 50 and 52 (as shown in FIG. 2) that is sufficient to accommodate the second electrical terminal 16 short side dimension therein along with the second insulator 42. The opposed cavity wall sections 50 and 52 connect with and extend horizontally a depth from the connecting member 22 at one end, and connect with a backside wall 54 of the second terminal port at an opposed end (as shown in FIG. 2).

The second terminal port internal cavity 40 includes a second section 56 that extends vertically away from the first section 48 and that forms a closed end 58 of the cavity. In an example, the second section 56 is cylindrical in shape with a diameter matching that of the first section opposed wall sections 50 and 52. The internal cavity second section 56 extends horizontally from the connecting member 22 at one end to the backside wall at an opposed end. The second terminal port 20 includes an open end 60 disposed through the housing base 24 to accommodate placement of the second electrical terminal 16 into the internal cavity 40. In an example, the internal cavity 40 has a length sized to accommodate placement a desired partial longitudinal dimension of the second electrical terminal 16 therein. In an example, it is desired that at least 25 percent, between about 30 to 75 percent, and between about 40 to 60 percent of the total length of the second electrical terminal 16 be accommodated within the second terminal port internal cavity 40.

As best illustrated in FIG. 1, the connecting member 22 forms a wall between the first and second terminal ports 18 and 20. In an example, a passage or opening 62 is disposed through the connecting member 22 that provides access between the first and second terminal ports. In an example, the opening 62 is sized to accommodate placement of one or both of a portion of the first electrical terminal 14 and the first insulator 36 therethrough for the purpose of connecting with second electrical terminal 16 within the housing. In an example, a peripheral end 64 of the first insulator 36 may be disposed in the opening and optionally may extend therethrough and connect with an adjacent portion of the second insulator 42. In an example, an axial end 66 of the first electrical terminal 14 extends beyond the first insulator 36 and through a portion of the second insulator 42 before it is placed in mechanical and electrical connection with the second electrical terminal 16. As noted above and better described below, a feature of angled header connectors as disclosed herein is that the first electrical terminal 14 and second electrical terminal 16 are connected together at a right-angle relative to one another in situ within the housing, enabling the housing to have a compact size and relatively low profile.

Figure 3:
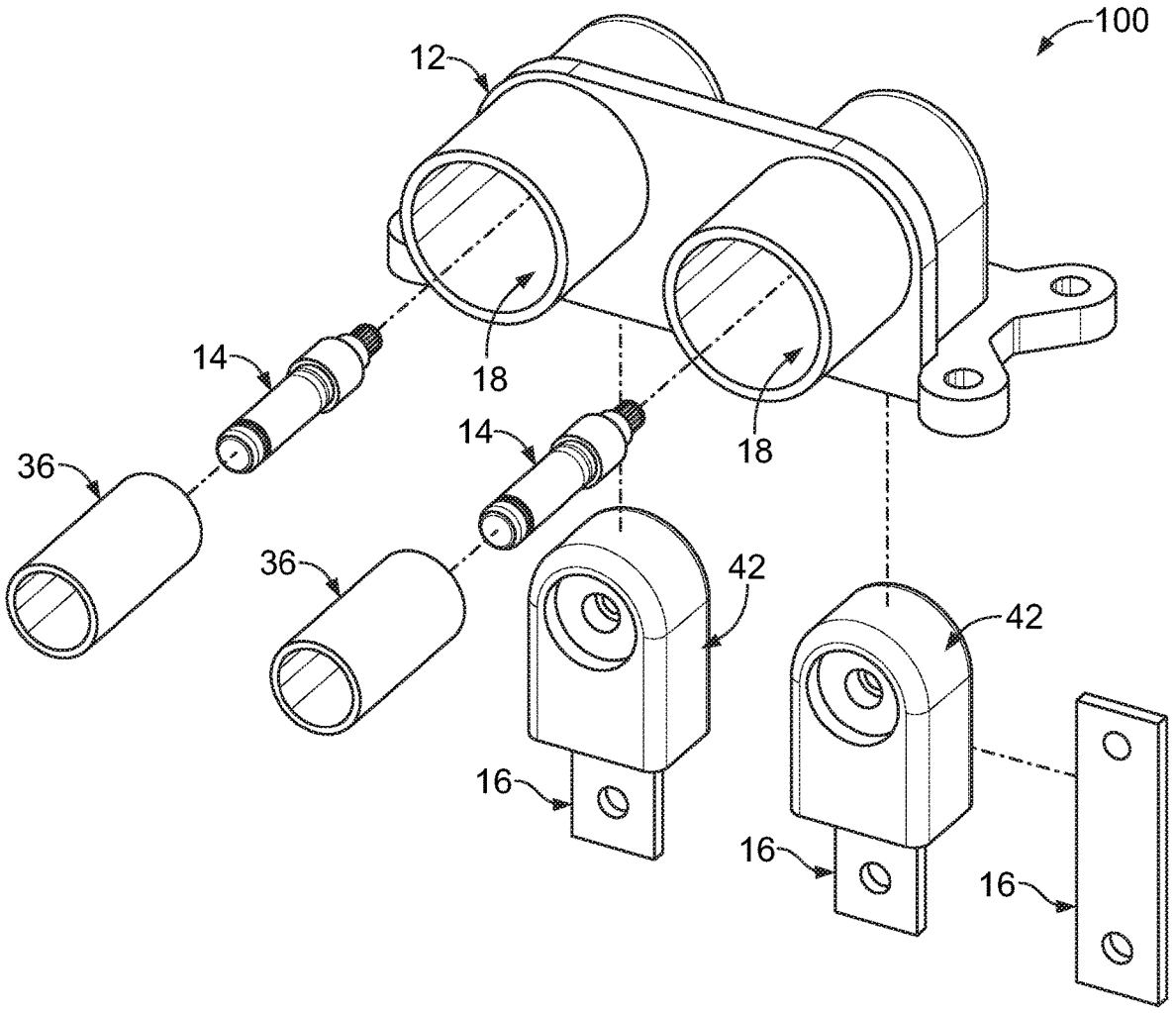
FIG. 3 is a perspective view of the angled electrical header connector shown in an unassembled state, in accordance with various embodiments.

FIG. 3 illustrates the example angled electrical header 100 in an unassembled state. In an example, the header is assembled by combining the first electrical terminals 14 with respective first insulators 36 outside of the housing 12. In an example, the first insulator 36 is formed from an electrically nonconductive material such as a plastic or polymer material and the like. In an example, the first insulator is made of polyvinyl chloride. Generally, the first insulator 36 is configured to electrically isolate the first electrical terminal 14 from the housing as well as fix the position of the first electrical terminal 14 to be in coaxial alignment within the first terminal port 18. Further, it is desired that the first insulator be configured to protect a connecting portion of the first electrical terminal 14 extending axially into the first terminal port, and to also facilitate engagement of the first electrical terminal 14 with a contact element of an external connector (not shown).

Referring to FIG. 1, in an example, the first insulator 36 comprises a body 102 having a central opening 104 disposed axially therethrough sized to accommodate placement of a portion of the first electrical terminal 14 therein. The first insulator comprises a wall section 106 that extends axially outwardly from the body 102 and into the first terminal port 18. The first insulator wall section 106 is sized to extend along a length of the first electrical terminal 14 disposed in the first terminal port 18. The wall section 106 protects a connecting portion 32 of the first electrical terminal 14 from inadvertent contact with an external element, and facilitates attachment with a contact element of an external terminal connector when engaged within the first terminal port for connection with the first electrical terminal 14.

Figure 4:
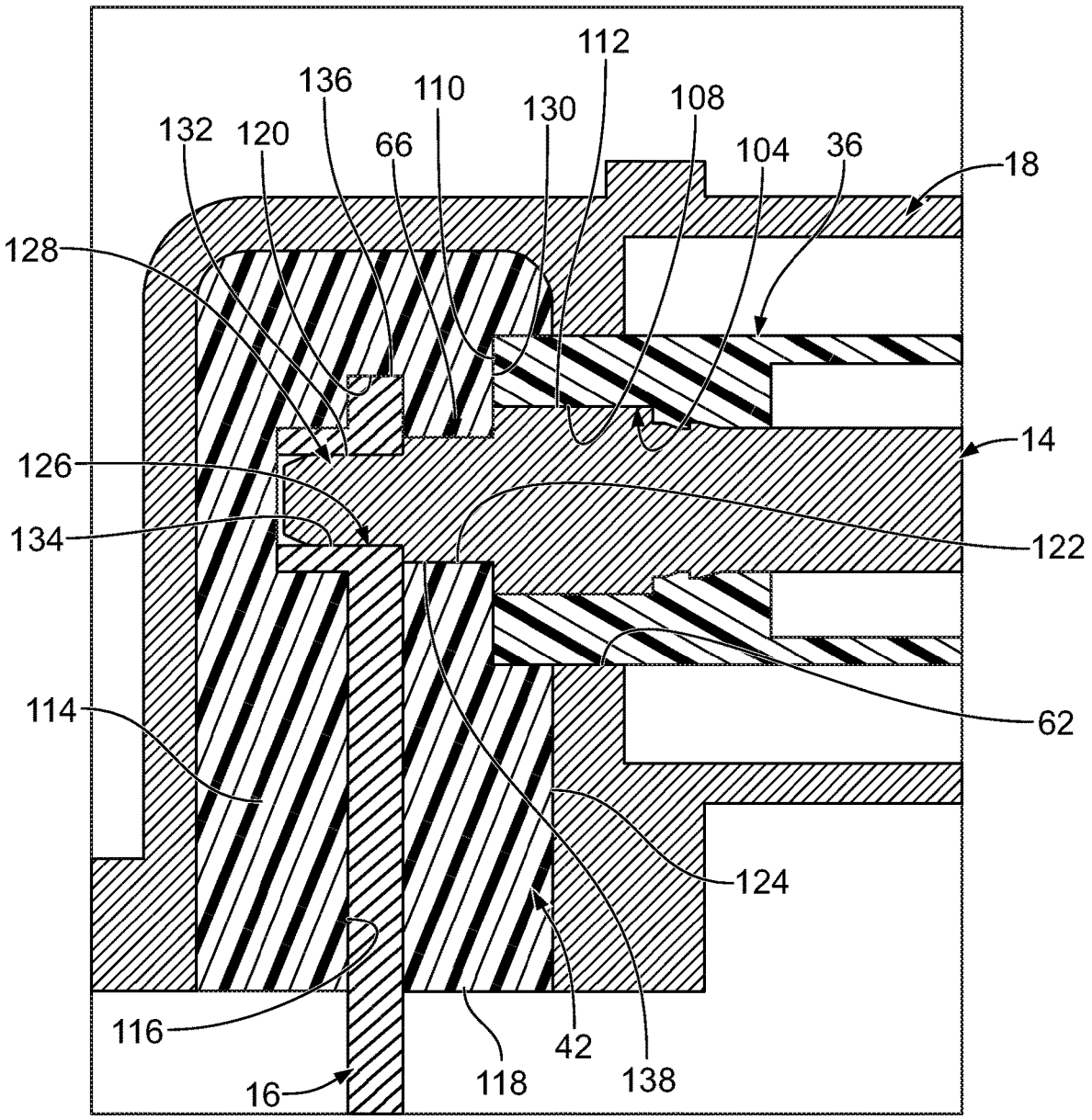
FIG. 4 is a cross-sectional side view of a portion of an angled electrical header connector showing connected electrical terminals disposed therein, in accordance with various embodiments.

In an example, the first insulator is a one-piece construction and the first electrical terminal 14 is combined therewith outside of the housing by a pressing process or the like to form a first terminal and first insulator assembly. With reference to FIG. 4, in an example, the central opening 104 of the first insulator 36 is configured having an enlarged diameter section 108 extending a partial axial length from axial end 110, and the first electrical terminal 14 is configured having an enlarged diameter section 112 adjacent axial end 66. In an example, the first electrical terminal 14 is inserted into the insulator through axial end 110 and registration of the first electrical terminal 14 enlarged diameter section 112 within the opening enlarged diameter section 108 operates to limit further axial displacement of the first electrical terminal 14 relative to the first insulator to indicate full insertion.

Alternatively, the first insulator may be formed from two or more elements that are combined around the first electrical terminal 14 before insertion into the housing. Still further, the first insulator may be configured for placement within the housing first terminal port, and thereafter the first electrical terminal 14 may be inserted into the first insulator. All such embodiments are understood to be within the scope of angled electrical header connectors as disclosed herein.

Referring to FIG. 3, the angled header connector is assembled by combining the second electrical terminals 16 with respective second insulators 42 outside of the housing 12 to form second terminal and second insulator assemblies. In an example, the second insulator 42 may be formed from the same types of materials disclosed above for the first insulator. Generally, the second insulator 42 is configured to electrically isolate the second electrical terminal 16 from the housing as well as provide a placement position of the second electrical terminal 16 within the second terminal port to facilitate connection and attachment with the first electrical terminal 14 while both electrical terminals are disposed within the housing.

Referring to FIGS. 1 and 4, in an example, the second insulator 42 comprises a body 114 having an opening 116 extending from one end 118 of the body a partial distance into the body that is defined by a closed end 120. The opening 116 is sized to accommodate placement of a partial length of the second electrical terminal 16 therein. The second insulator also includes a hole 122 disposed through a frontside surface 124 of the body, wherein the hole 122 extends to the opening 116 and is perpendicular thereto. With reference to FIG. 4, when the second electrical terminal 16 is disposed within the second insulator opening 116, the placement position of the hole 122 aligns with an attachment feature 126 in the second electrical terminal 16 and exposes such attachment feature through the hole 122 for engagement by an attachment feature 128 of the first electrical terminal 14.

In an example, the second insulator is a one-piece construction and the second electrical terminal 16 is combined therewith outside of the housing by a pressing process or the like. Alternatively, the second insulator may be formed from two or more elements that are combined around the second electrical terminal 16 before insertion into the housing. Still further, the second insulator may be configured for placement within the housing second terminal port, and then the second electrical terminal 16 may be inserted therein. All such embodiments are understood to be within the scope of angled electrical header connectors as disclosed herein.

Further, while first and second insulators have been described in the form of a preformed element that is then combined with the respective first electrical terminal 14 and second electrical terminal 16, it is to be understood that the first and/or second insulators as used herein may be provided by an overmold process, whereby the desired nonconductive material is combined with the respective electrical terminal and the material is molded over the electrical terminal into a desired form for insertion of the so-formed electrical terminal and insulator assembly into the housing. Further, in an event that the housing is formed from a plastic material, the electrical terminal insulators may be made as part of the housing itself (e.g., the insulators may be integral with the housing), and may not be configured as a separate element combine therewith. It is to be understood that such alternative embodiment is within the scope of angled header connectors as disclosed herein.

Referring to FIGS. 1 and 4, in an example, the second insulator 42 may include a recessed circular section 130 positioned coaxially around the hole 122 that is configured to accommodate the axial end 110 of the first insulator therein (as best shown in FIG. 4), which operates to provide an extra degree of insulation between the first electrical terminal 14 and the connection member opening 62, and may aid registration and engagement of the first electrical terminal 14 with the second electrical terminal 16. It is to be understood that such recessed section 130 is optional, and instead each of the first and second insulators may be configured having planar surface portions that abut against one another when both are placed in the housing, or the first and second insulators may have some other form of cooperating surface feature that facilitates combining or registering of adjacent portions of the first and second insulators together within the housing.

In an example, the angled header connector is assembled by first engaging and fully inserting the combined second electrical terminal 16 and second insulator into the housing second terminal port by pressing technique or the like. The combined first electrical terminal 14 and first insulator are next engaged with and installed into the housing first terminal port. With reference to FIG. 4, as the first electrical terminal 14 and first insulator 36 is installed into the first terminal port 18, the axial end 66 of the first electrical terminal 14 extends outwardly from the first insulator and projects through the second insulator hole 122. The first electrical terminal axial end 66 includes the attachment feature 128 that engages the attachment feature 126 of the second electrical terminal 16 to thereby form a strong mechanical attachment and electrical connection between the first electrical terminal 14 and second electrical terminal 16 while each is disposed within the housing, i.e., in situ within the housing. In an example, the first electrical terminal axial end 66 comprises a first section 132 that extends axially a length from the end and that forms the attachment feature 128. The axial end first section 132 is sized to fit within the second electrical terminal attachment feature 126 that provided in the form of an elongate cylindrical opening 134 positioned adjacent a second electrical terminal end 136. The axial end first section 132 extends to a second enlarged diameter section 138 that operates to limit a total insertion depth of the first section 132 into the elongate cylindrical opening 134.

Figure 5:
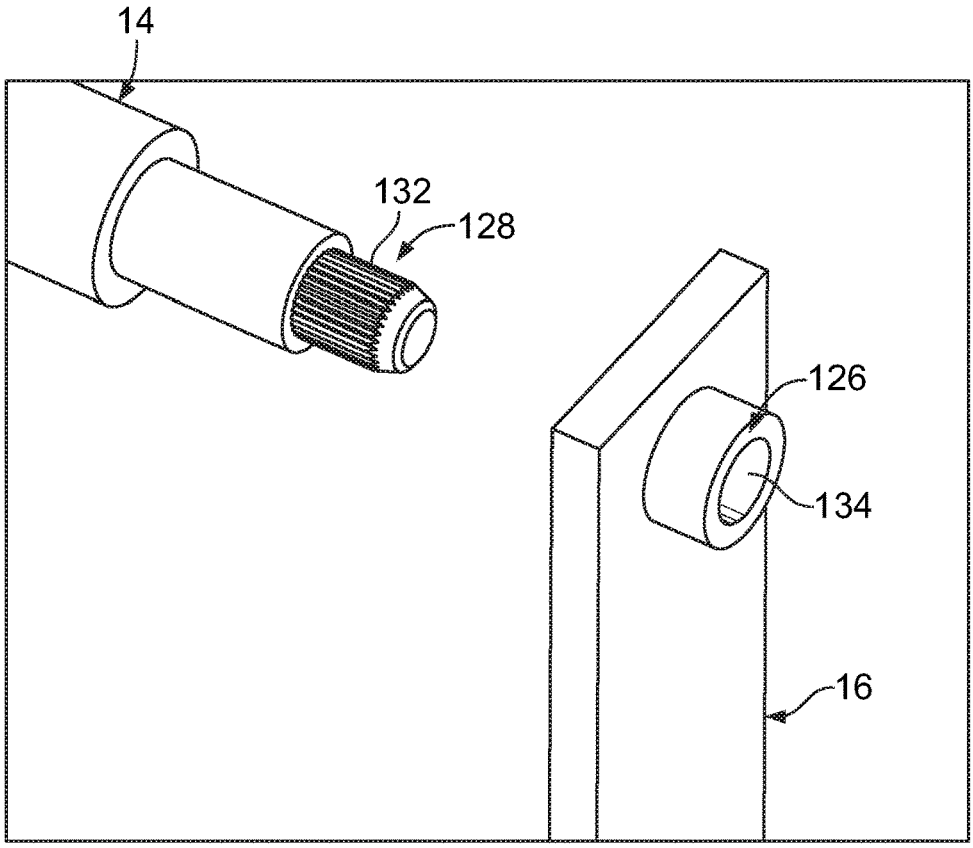
FIG. 5 is a perspective view of an example electrical terminal attachment configuration as used in the angled electrical header connectors, in accordance with various embodiments.

FIG. 5 illustrates the first electrical terminal 14 and second electrical terminal 16, and example respective attachment features 128 and 126. In this example, the first electrical terminal axial end first section 132 is treated to have knurled surface features. In this example, the second electrical terminal elongate cylindrical opening 134 is configured having a smooth inside diameter surface. Upon insertion of the first electrical terminal axial end first section 132 into the second electrical terminal elongate cylindrical opening 134, the knurled surface features of the axial end first section 132 operates to form a strong mechanical interlocking fit with the elongate cylindrical opening 134, thereby forming a robust mechanical attachment and electrical connection between the first electrical terminal 14 and second electrical terminal 16.

Figure 6:
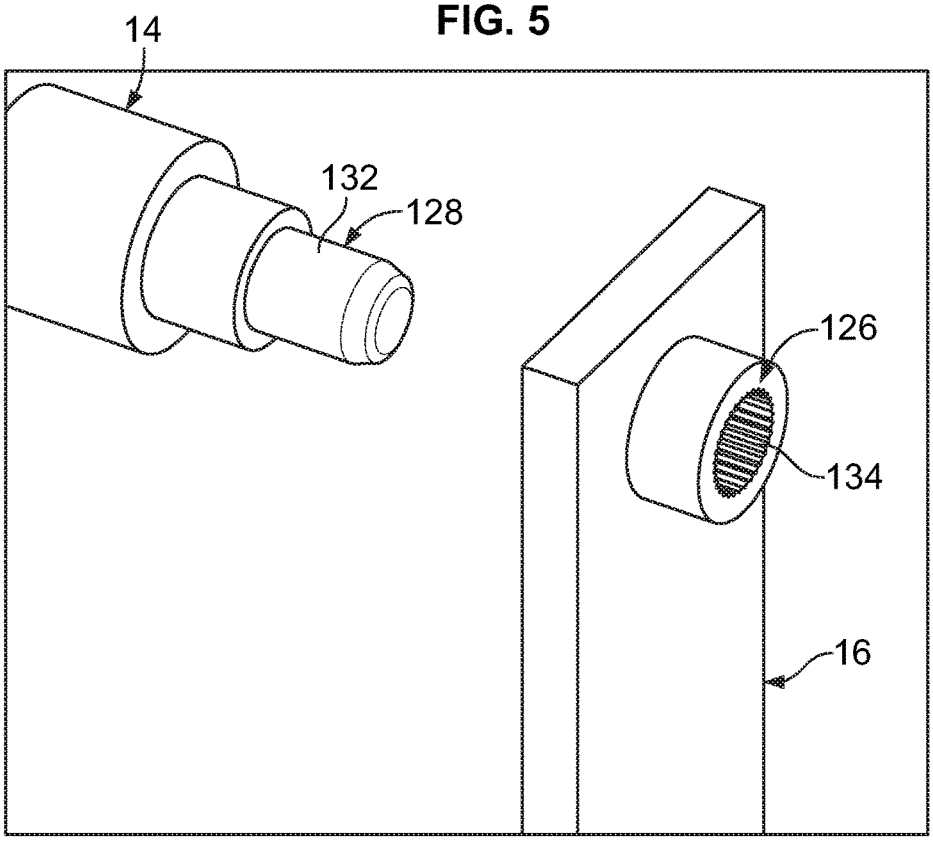
FIG. 6 is a perspective view of another example electrical terminal attachment configuration as used in the angled electrical header connectors, in accordance with various embodiments.

FIG. 6 illustrates the first and second electrical terminals 14 and 16, and example respective attachment features 128 and 126. In this example, the first electrical terminal axial end first section 132 has a smooth outside surface, and the second electrical terminal elongate cylindrical opening 134 is configured having a knurled surface features along an inside diameter surface. Upon insertion of the first electrical terminal axial end first section 132 into the second electrical terminal elongate cylindrical opening 134, the knurled surface features inside of the elongate cylindrical opening operates to form a strong mechanical interlocking fit with the first electrical terminal axial end first section, thereby forming a robust mechanical attachment and electrical connection between the first and second electrical terminals 14 and 16.

While first electrical terminals 14 and second electrical terminals 16 have been disclosed and illustrated having certain complementary attachment features, it is to be understood that other types and/or configurations of attachment features that are capable of performing the function of providing a strong mechanical attachment and electrical connection between the first and second electrical terminals 14 and 16 while each are disposed within the housing are intended to be within the scope of angled header connectors as disclosed herein. For example, while the use of an elongate cylindrical opening has been disclosed as an attachment feature of the second electrical terminal 16, alternatively the second electrical terminal 16 may be configured having a greater thickness than illustrated to thereby provide an equivalent attachment surface area with the first electrical terminal axial end 66.

Also, while the first electrical terminal attachment feature has been disclosed in the form of an axial end inserted into the second electrical terminal attachment feature in the form of an opening, alternatively the first electrical terminal attachment feature may be provided in the form of an opening that accepts a second electrical terminal attachment feature in the form of a pin or other projecting element extending therefrom for purposes of forming the desired in situ mechanical attachment and electrical connection therebetween while disposed within the housing.

A feature of angled electrical header connectors as disclosed herein is the ability to connect together the first and second electrical terminals 14 and 16 at a right-angle to one another while the electrical terminals are both disposed within the connector housing, thereby enabling use of a smaller sized housing and resulting header connector to expand the flexibility and spectrum of space-constrained end-use applications. Further features of such angled header connectors are the robust mechanical attachment and electrical connection provided between the first and second electrical connectors, and improved insulation between the electrical terminals and the housing, to thereby provide improved resistance to high vibration environments and facilitate use in high-power transmission applications. A still further feature of such angled header connectors is the use of a one-piece housing that reduces cost and increases reliability when contrasted with a multi-piece housing that requires proper assembly and sealing of the different pieces used to form the multi-piece housing.

The foregoing description and accompanying figures illustrate the principles, preferred embodiments and modes of operation of the angled electrical header connectors as disclosed herein. However, such angled electrical header connectors should not be construed as being limited to the particular embodiments discussed above. Additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the angled header connectors as defined by the following claims.

For example, the steps recited in any of the method or process descriptions may be executed in any order and are not limited to the order presented. Moreover, any of the functions or steps may be outsourced to or performed by one or more third parties. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. Furthermore, any reference to singular includes plural embodiments, and any reference to more than one component may include a singular embodiment. Although specific advantages have been enumerated herein, various embodiments may include some, none, or all of the enumerated advantages.

In the detailed description herein, references to "in an example," "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

What is claimed is:

1. An angled header for providing an electrical connection comprising:

a housing comprising a first electrical terminal port and a second electrical terminal port, wherein the first electrical terminal port is oriented in a different direction than the second electrical terminal port;

a first electrical terminal disposed within the first electrical terminal port, wherein a first electrical insulator is interposed between the first electrical terminal port and the first electrical terminal, the first electrical insulator comprising a wall section extending from adjacent an open end of the first electrical terminal port and that is sized to provide an open annular space between opposed surfaces of the first electrical terminal and the first electrical insulator, wherein the open annular space is configured to accommodate an external connector feature therein, the first electrical insulator comprising an end section in direct contact with the first electrical terminal and interposed between the first electrical terminal and the housing to electrically insulate the first electrical terminal from the housing; and a second electrical terminal disposed within the second electrical terminal port, wherein a second electrical insulator is interposed between the second electrical terminal port and the second electrical terminal;

wherein the first electrical terminal and the second electrical terminal each include first axial ends respectively extending outwardly from the first electrical terminal port and the second electrical terminal port, and wherein the first electrical terminal and the second electrical terminal each include an attachment feature adjacent second axial ends configured to complement one another to make an electrical-mechanical connection with one another while disposed within the housing.

2. The angled header as recited in claim 1, wherein the first electrical terminal is oriented approximately 90 degrees apart from the second electrical terminal, and wherein the housing is a one-piece construction.

3. The angled header as recited in claim 1, wherein one of the first electrical terminal attachment feature or the second electrical terminal attachment feature comprises an opening for accommodating placement of the attachment feature in a form of an axial post of the other of the first electrical terminal or the second electrical terminal to provide the electrical-mechanical connection therebetween.

4. The angled header as recited in claim 3, wherein one of the first electrical terminal attachment feature or the second electrical terminal attachment feature comprises surface features that operate to provide the electrical-mechanical connection therebetween when joined together.

5. The angled header as recited in claim 3, wherein the first electrical terminal comprises the axial post and the second electrical terminal comprises the opening.

6. The angled header as recited in claim 1, wherein the housing is formed from a structurally rigid material and the first electrical terminal port and the second electrical terminal port are integral with the housing.

7. The angled header as recited in claim 1, wherein a portion of the first electrical terminal that is in the electrical-mechanical connection with the second electrical terminal is disposed in the second electrical terminal port.

8. The angled header as recited in claim 1, wherein the first electrical terminal port and the second electrical terminal port are separated by a housing wall, and wherein the housing wall has an opening disposed therethrough accommodating placement of a portion of the first electrical terminal comprising the attachment feature into the second electrical terminal port.

9. The angled header as recited in claim 1, wherein the first electrical terminal is in a form of a round pin and the first electrical insulator is separate from the housing, and comprising another open annual space between opposed surfaces of the first electrical terminal port and the first electrical insulator wall section.

10. A right-angle electrical header connector comprising:

a housing comprising a first electrical terminal port and a second electrical terminal port, wherein the first electrical terminal port is positioned approximately 90 degrees from the second electrical terminal port;

a first electrical terminal and a first electrical insulator assembly disposed within the first electrical terminal port, wherein the first electrical insulator is separate from the housing and formed from an electrically nonconductive material and comprises a wall section and an end section, wherein the wall section is interposed between the first electrical terminal and the first electrical terminal port and extends axially inwardly adjacent an open end of the first electrical terminal port, wherein the wall section forms a first open annular space and a second open annular space, wherein the first open annular space extends radially between opposed surfaces of the first electrical terminal port and the wall section adjacent the open end, wherein the second open annular space extends radially between opposed surfaces of the first electrical terminal and the wall section adjacent the open end; and a second electrical terminal and a second electrical insulator assembly disposed within the second electrical terminal port, wherein the second electrical insulator is interposed between the second electrical terminal and the second electrical terminal port;

wherein the first electrical terminal includes an attachment feature that extends into the second electrical terminal port, wherein the second terminal includes an attachment feature, and wherein the first electrical terminal attachment feature and the second electrical terminal attachment feature are mechanically attached and electrically connected with one other in situ within the housing to form a fixed electrical-mechanical connection therebetween.

11. The right-angle electrical header connector as recited in claim 10, wherein the first electrical terminal and the first electrical insulator assembly is disposed in the first electrical terminal port by a mechanical interference fit, and wherein the second electrical terminal and the second electrical insulator assembly are disposed in the second electrical terminal port by a mechanical interference fit.

12. The right-angle electrical header connector as recited in claim 10, wherein the electrical-mechanical connection between the first electrical terminal and the second electrical terminal is made by axial displacement of the first electrical terminal in the first electrical terminal port into contact with the second electrical terminal disposed in the second electrical terminal port.

13. The right-angle electrical header connector as recited in claim 10, wherein the attachment feature of one of the first electrical terminal or the second electrical terminal comprises an opening, and the attachment feature of the other of the first electrical terminal or the second electrical terminal comprises an axial end that engages and attaches with the opening to form the electrical-mechanical connection therebetween.

14. The right-angle electrical header connector as recited in claim 10, wherein the first electrical terminal port and the second electrical terminal port are integral with the housing, wherein a passage exists within the housing between the first electrical terminal port and the second electrical terminal port, and wherein one of the first electrical terminal or the second electrical terminal is disposed through the passage.

15. The right-angle electrical header connector as recited in claim 10, wherein the first electrical terminal is in a form of a round pin terminal and the second electrical terminal is in the form of a flat terminal.

16. The right-angle electrical header connector as recited in claim 10, wherein the housing includes a passage extending between the first electrical terminal port and the second electrical terminal port, and wherein a portion of the first electrical terminal comprising the attachment feature is disposed within the passage.

17. The right-angle electrical header connector as recited in claim 16, wherein the first electrical insulator is interposed between the passage and the first electrical terminal.

18. A method for making a right-angle header comprising:

forming a first electrical terminal and a first electrical insulator assembly by surrounding at least a portion of an outside surface of the first electrical terminal with a first electrical insulator, wherein the first electrical insulator comprises a wall structure extending axially therefrom along a length of the first electrical terminal, wherein an open annular space extends radially between the wall structure and the first electrical terminal, the first electrical insulator comprising an end section that is in direct contact with the first electrical terminal;

forming a second electrical terminal and a second electrical insulator assembly by surrounding at least a portion of an outside surface of the second electrical terminal with a second electrical insulator;

inserting the first electrical terminal and the first electrical insulator assembly into a first electrical terminal port of a housing, and inserting the second electrical terminal and the second electrical insulator assembly into a second electrical terminal port of the housing, wherein the first electrical terminal port and the second electrical terminal port are oriented within the housing approximately 90 degrees from one another, wherein the open annular space extends inwardly from adjacent an open end of the first electrical terminal port, and wherein a portion of the first electrical insulator adjacent the end section is interposed between the first electrical terminal and housing to electrically insulate the first electrical terminal from the housing; and moving one of the first electrical terminal or the second electrical terminal within its respective first electrical terminal port or second electrical terminal port to form a fixed electrical-mechanical connection in the housing with the other of the first electrical terminal or the second electrical terminal.

19. The method as recited in claim 18, wherein the forming one or both of the first electrical terminal and the first electrical insulator assembly and the second electrical terminal and the second electrical insulator assembly comprises respectively inserting one or both of the first electrical terminal and the second electrical terminal into a cavity disposed within the first electrical insulator and the second electrical insulator.

20. The method as recited in claim 18, wherein the moving comprises axially displacing the first electrical terminal within the first electrical terminal port to enter the second electrical terminal port such that an attachment feature of the first electrical terminal engages and attaches with an attachment feature of the second electrical terminal to form the fixed electrical-mechanical connection therebetween.

* * * * *